US008759278B2

(12) United States Patent
Corominas et al.

(10) Patent No.: US 8,759,278 B2
(45) Date of Patent: Jun. 24, 2014

(54) METHOD OF PRODUCING A FABRIC SOFTENING COMPOSITION

(71) Applicant: The Proctor & Gamble Company, Cincinnati, OH (US)

(72) Inventors: Francesc Corominas, Grimbergen (BE); Ke-Ming Quan, West Chester, OH (US); Yunpeng Yang, Mason, OH (US); Kenny Peers, Waregem (BE)

(73) Assignee: The Procter & Gamble Company, Cincinnati, OH (US)

( * ) Notice: Subject to any disclaimer, the term of this patent is extended or adjusted under 35 U.S.C. 154(b) by 21 days.

(21) Appl. No.: 13/763,862

(22) Filed: Feb. 11, 2013

(65) Prior Publication Data

US 2013/0150280 A1 Jun. 13, 2013

Related U.S. Application Data

(63) Continuation of application No. 13/592,791, filed on Aug. 23, 2012, now abandoned, which is a continuation of application No. 12/984,663, filed on Jan. 5, 2011, now abandoned.

(60) Provisional application No. 61/294,533, filed on Jan. 13, 2010.

(51) Int. Cl.

| | |
|---|---|
| ***C11D 11/00*** | (2006.01) |
| ***B01F 5/06*** | (2006.01) |
| ***C11D 3/00*** | (2006.01) |
| ***B01F 13/10*** | (2006.01) |
| ***B01F 3/08*** | (2006.01) |

(52) U.S. Cl.

CPC ..... *B01F 5/0661* (2013.01); *B01F 5/0688* (2013.01); *C11D 3/0015* (2013.01); *B01F 13/1027* (2013.01); *B01F 5/0682* (2013.01); *B01F 5/0646* (2013.01); *B01F 3/0861* (2013.01); *B01F 3/0807* (2013.01); *C11D 11/0094* (2013.01); *B01F 5/0654* (2013.01)

USPC ..... 510/527; 510/522

(58) Field of Classification Search

CPC ..... C11D 3/0015; C11D 11/0094

USPC ..... 510/522, 527

See application file for complete search history.

(56) References Cited

U.S. PATENT DOCUMENTS

| | | | |
|---|---|---|---|
| 2,567,998 | A | 9/1951 | Griffith |
| 3,169,013 | A | 2/1965 | Jones |

(Continued)

FOREIGN PATENT DOCUMENTS

| | | | |
|---|---|---|---|
| CN | 2413784U | Y | 1/2001 |
| CN | 201073592 U | Y | 6/2008 |

(Continued)

OTHER PUBLICATIONS

Chapter 12 "Techniques of Emulsification" of a book entitled Emulsions—Theory and Practice, 3rd Ed., Paul Becher, American Chemical Society and Oxford University Press, NY, NY, 2001.

(Continued)

*Primary Examiner* — John Hardee

(74) *Attorney, Agent, or Firm* — James F. McBride; Steven W. Miller

(57) ABSTRACT

The present invention is to process of making a liquid fabric softening composition using shear, turbulence and/or cavitation, but which requires lower operating pressures than conventional shear, turbulence and/or cavitation processes.

7 Claims, 2 Drawing Sheets

(56) References Cited

U.S. PATENT DOCUMENTS

| | | | |
|---|---|---|---|
| 3,176,964 | A | 4/1965 | Cottell et al. |
| 3,410,529 | A | 11/1968 | Simonetti |
| 3,526,391 | A | 9/1970 | Church |
| 3,545,492 | A | 12/1970 | Scheid |
| 3,582,047 | A | 6/1971 | Greene |
| 3,582,048 | A | 6/1971 | Sarem |
| 3,648,984 | A | 3/1972 | Mimura et al. |
| 3,926,413 | A | 12/1975 | D'Urso |
| 4,127,332 | A | 11/1978 | Thiruvengadam et al. |
| 4,441,823 | A | 4/1984 | Power |
| 4,501,501 | A | 2/1985 | Edwards |
| 2,041,485 | A | 4/1992 | Pajula |
| 5,387,376 | A | 2/1995 | Gasser |
| 5,397,179 | A | 3/1995 | Berlin et al. |
| 5,810,052 | A | 9/1998 | Kozyuk |
| 5,931,771 | A | 8/1999 | Kozyuk |
| 5,937,906 | A | 8/1999 | Kozyuk |
| 5,969,207 | A | 10/1999 | Kozyuk |
| 5,971,601 | A | 10/1999 | Kozyuk |
| 6,012,492 | A | 1/2000 | Kozyuk |
| 6,035,897 | A | 3/2000 | Kozyuk |
| 6,502,979 | B1 | 1/2003 | Kozyuk |
| 6,530,684 | B1 | 3/2003 | Kolb et al. |
| 6,536,940 | B1 | 3/2003 | Kolb et al. |
| 6,562,247 | B2 | 5/2003 | Gillis et al. |
| 6,589,501 | B2 | 7/2003 | Moser et al. |
| 6,647,806 | B1 | 11/2003 | Estrada et al. |
| 6,722,780 | B2 | 4/2004 | Stein et al. |
| 6,802,639 | B2 | 10/2004 | Kozyuk |
| 6,857,774 | B2 | 2/2005 | Kozyuk |
| 6,869,586 | B1 | 3/2005 | Moser et al. |
| 7,086,777 | B2 | 8/2006 | Kozyuk |
| 7,178,975 | B2 | 2/2007 | Kozyuk |
| 7,207,712 | B2 | 4/2007 | Kozyuk |
| 7,357,566 | B2 | 4/2008 | Kozyuk |
| 7,667,082 | B2 | 2/2010 | Kozyuk |
| 7,717,297 | B2 | 5/2010 | Kadyk et al. |
| 7,754,905 | B2 | 7/2010 | Kozyuk |
| 7,789,273 | B2 | 9/2010 | Kadyk et al. |
| 7,935,157 | B2 | 5/2011 | Kozyuk et al. |
| 8,322,910 | B2 * | 12/2012 | Gansmuller et al. ..... 366/173.1 |
| 2002/0060950 | A1 | 5/2002 | Furukawa |
| 2003/0069158 | A1 | 4/2003 | Ilett |
| 2010/0002535 | A1 | 1/2010 | Cho |
| 2010/0020632 | A1 | 1/2010 | Corominas |
| 2010/0112125 | A1 | 5/2010 | Kozyuk |
| 2010/0124145 | A1 | 5/2010 | Ni et al. |
| 2011/0070639 | A1 | 3/2011 | Pandit et al. |
| 2011/0079610 | A1 | 4/2011 | Kadyk et al. |
| 2011/0172137 | A1 | 7/2011 | Corominas et al. |
| 2011/0259971 | A1 | 10/2011 | Askin et al. |
| 2011/0275553 | A1 | 11/2011 | Leopold et al. |
| 2012/0316098 | A1 | 12/2012 | Corominas et al. |

FOREIGN PATENT DOCUMENTS

| | | | |
|---|---|---|---|
| DE | 198 56 604 | A1 | 6/2000 |
| DE | 20 2006 001952 | U1 | 6/2007 |
| DE | 10 2006 011655 | A1 | 9/2007 |
| DE | 10 2007 011205 | A1 | 9/2008 |
| EP | 0 922 755 | A1 | 6/1999 |
| EP | 2 287 283 | A1 | 2/2011 |
| JP | 58 027626 | A | 2/1983 |
| JP | 2004 057873 | A | 2/2004 |
| RU | 2435839 | C1 | 12/2011 |
| WO | WO 98/11983 | A1 | 3/1998 |
| WO | WO 99/11363 | A1 | 3/1999 |
| WO | WO 01/64333 | A2 | 9/2001 |
| WO | WO 2009/039477 | A1 | 3/2009 |

OTHER PUBLICATIONS

Search Report—9 pages.

* cited by examiner

METHOD OF PRODUCING A FABRIC SOFTENING COMPOSITION

This is a continuation of U.S. patent application Ser. No. 13/592,791, filed Aug. 8, 2012, now abandoned, which is a continuation of U.S. patent application Ser. No. 12/984,663, filed Jan. 5, 2011, now abandoned, which claims priority from Provisional U.S. Application 61/294,533, filed Jan. 13, 2010.

FIELD OF THE INVENTION

The present invention is directed to a process for making a fabric softening composition using a device for producing shear, turbulence and/or cavitation, that requires lower operating pressures to achieve the same degree of mixing as seen with alternative methods using shear, turbulence and/or cavitation apparatuses already known in the art.

BACKGROUND TO THE INVENTION

One process of making a liquid fabric softening composition is by mixing the components of the composition using cavitation. Cavitation refers to the process of forming vapor bubbles in a liquid. This can be done in a number of manners, such as through the use of a swiftly moving solid body (as an impeller), hydrodynamically, or by high-frequency sound waves. When the bubbles collapse further downstream from the forming location, they release a certain amount of energy, which can be utilized for making chemical or physical transformations.

One particular method for producing hydrodynamic cavitation uses an apparatus known as a liquid whistle. Liquid whistles are described in Chapter 12 "Techniques of Emulsification" of a book entitled Emulsions—Theory and Practice, 3rd Ed., Paul Becher, American Chemical Society and Oxford University Press, NY, N.Y., 2001. An example of a liquid whistle is a SONOLATOR® high pressure homogenizer, which is manufactured by Sonic Corp. of Stratford, Conn., U.S.A.

Processes using liquid whistles have been used for many years. The apparatuses have been used as in-line systems, single or multi-feed, to instantly create fine, uniform and stable emulsions, dispersions, and blends in the chemical, personal care, pharmaceutical, and food and beverage industries.

It has been found, however, that improvements to such methods are desirable. Current processes utilizing liquid whistle apparatuses require the liquid(s) intending to be mixed, to enter the liquid whistle under very high operating pressures, in some cases up to 1000 bar. By operating pressure, it is understood to mean the pressure of the liquid(s) as it enters the liquid whistle device. This ensures efficient mixing of the liquids within the apparatus. However, achieving such high pressures is expensive, energy consuming, and requires the use of large bulky equipment, such as the Sonolator® High Pressure Homogenizer. Another problem with such high pressures is that they can cause erosion of components within the mixing device. This is usually due to mechanical wear caused by the high pressure liquids, but can also be exacerbated by the chemical properties of the liquid(s) being mixed.

There is a need in the art for improvements to processes for making fabric softener compositions by producing shear, turbulence and/or cavitation, such that lower pressures can be used, yet the same degree of mixing can still be achieved as is seen with alternative high pressure apparatuses.

There is also a need in the art to minimize the erosion of internal components of high pressure mixing apparatuses.

It was surprisingly found that the methods of the present invention, which comprise mixing a fabric softening active in liquid form with a second liquid composition using an apparatus comprising two or more orifices arranged in series, achieved a comparable or better degree of mixing as is seen with known shear and/or cavitation mixing methods, but required decreased pressures than are normally required.

SUMMARY OF THE INVENTION

The present invention is to a process of producing a liquid fabric softening composition comprising a fabric softening active, said process comprising the steps of;

Taking an apparatus 100 comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear, turbulence and/or cavitation in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear, turbulence and/or cavitation in the liquid, the at least one outlet 9 being located at the downstream end of the secondary mixing chamber 8; the orifice component 5 comprising at least two orifice units, 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighbouring orifice plates are distinct from each other;

connecting one or more suitable liquid pumping devices to the first inlet 1A and to the second inlet 1B;

pumping a liquid fabric softening active composition into the first inlet 1A, and, pumping a second liquid composition into the second inlet 1B, wherein the operating pressure of the apparatus is between 0.1 bar and 50 bar, the operating pressure being the pressure of the liquid as measured in the pre-mix chamber 2;

allowing the liquid fabric softening active and the second liquid composition to pass through the apparatus 100 at a desired flow rate, wherein as they pass through the apparatus 100, they are dispersed one into the other;

discharging the resultant liquid fabric softening composition produced out of the outlet 9.

Another aspect of the present invention is a liquid fabric softening composition made according to the process detailed in the first aspect of this invention.

DETAILED DESCRIPTION OF THE INVENTION

In the context of the present invention, the terms "a" and "an" mean at "at least one".

When describing the "two orifices" or "two orifice units" of the present invention, we herein mean "at least two orifices" or "at least two orifice units".

By "shear" we herein mean, a strain produced by pressure in the structure of a substance, when its layers are laterally shifted in relation to each other.

By "turbulence" we herein mean, the irregular and disordered flow of fluids.

By "cavitation" we herein mean, the formation of bubbles in a liquid due to the hydrodynamics of the liquid and the collapsing of those bubbles further downstream.

By "operating pressure" we herein mean the pressure of the liquid(s) in the pre-mix chamber 2.

The present invention is directed to a process for making a fabric softening composition using an apparatus for mixing the liquid fabric softening composition components by producing shear, turbulence and/or cavitation. It should be understood that, in certain embodiments, the ability of the process to induce shear may not only be useful for mixing, but may also be useful for dispersion of solid particles in liquids, liquid in liquid dispersions and in breaking up solid particles. In certain embodiments, the ability of the process to induce shear and/or produce cavitation may also be useful for droplet and/or vesicle formation.

The Apparatus

Figure 1:
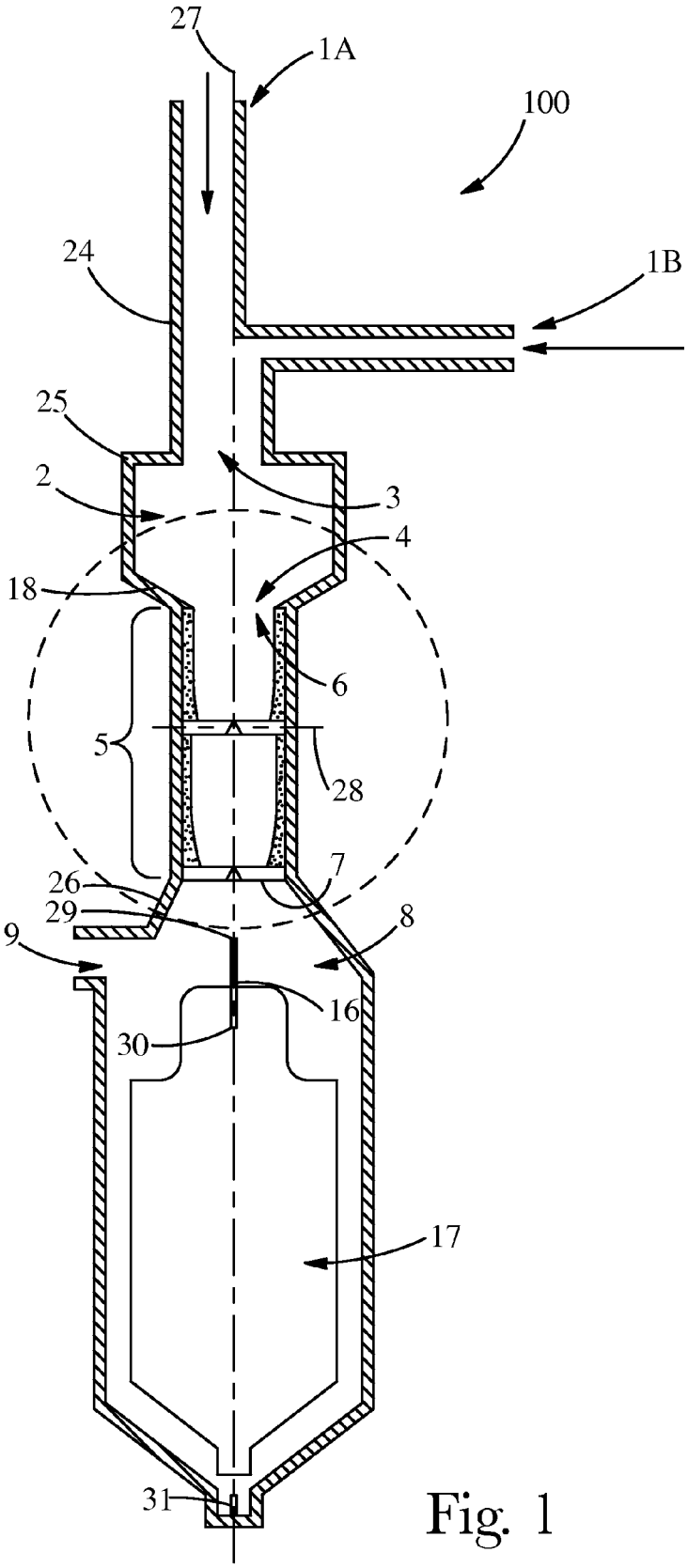
FIG. 1 details the apparatus 100 used in the method of the present invention.

FIG. 1 shows one non-limiting embodiment of an apparatus 100 for mixing liquids by producing shear, turbulence and/or cavitation, said apparatus comprising, at least one inlet 1A and a pre-mixing chamber 2. The pre-mixing chamber has an upstream end 3 and a downstream end 4, the upstream end 4 being in liquid communication with the at least one inlet 1A. The apparatus 100 also comprises an orifice component 5, the orifice component 5 having an upstream end 6 and a downstream end 7. The upstream end of the orifice component 6 is in liquid communication with the downstream end 4 of the pre-mixing chamber 2, and the orifice component 5 is configured to spray liquid in the form of a jet and produce shear or cavitation in the liquid. A secondary mixing chamber 8 is in liquid communication with the downstream end 7 of the orifice component 5. At least one outlet 9 communicates with the secondary mixing chamber 8 for discharge of liquid following the production of shear, turbulence or cavitation in the liquid, and is located at the downstream end of the secondary mixing chamber 8.

A liquid(s) can be introduced into the inlet 1A at a desired operating pressure. The liquid can be introduced at a desired operating pressure using standard liquid pumping devices. The liquid flows from the inlet into the pre-mix chamber 2 and then into the orifice component 5. The liquid will then exit the orifice component 5 into the secondary mixing chamber 8, before exiting the apparatus 100 through the outlet 9.

Figure 2:
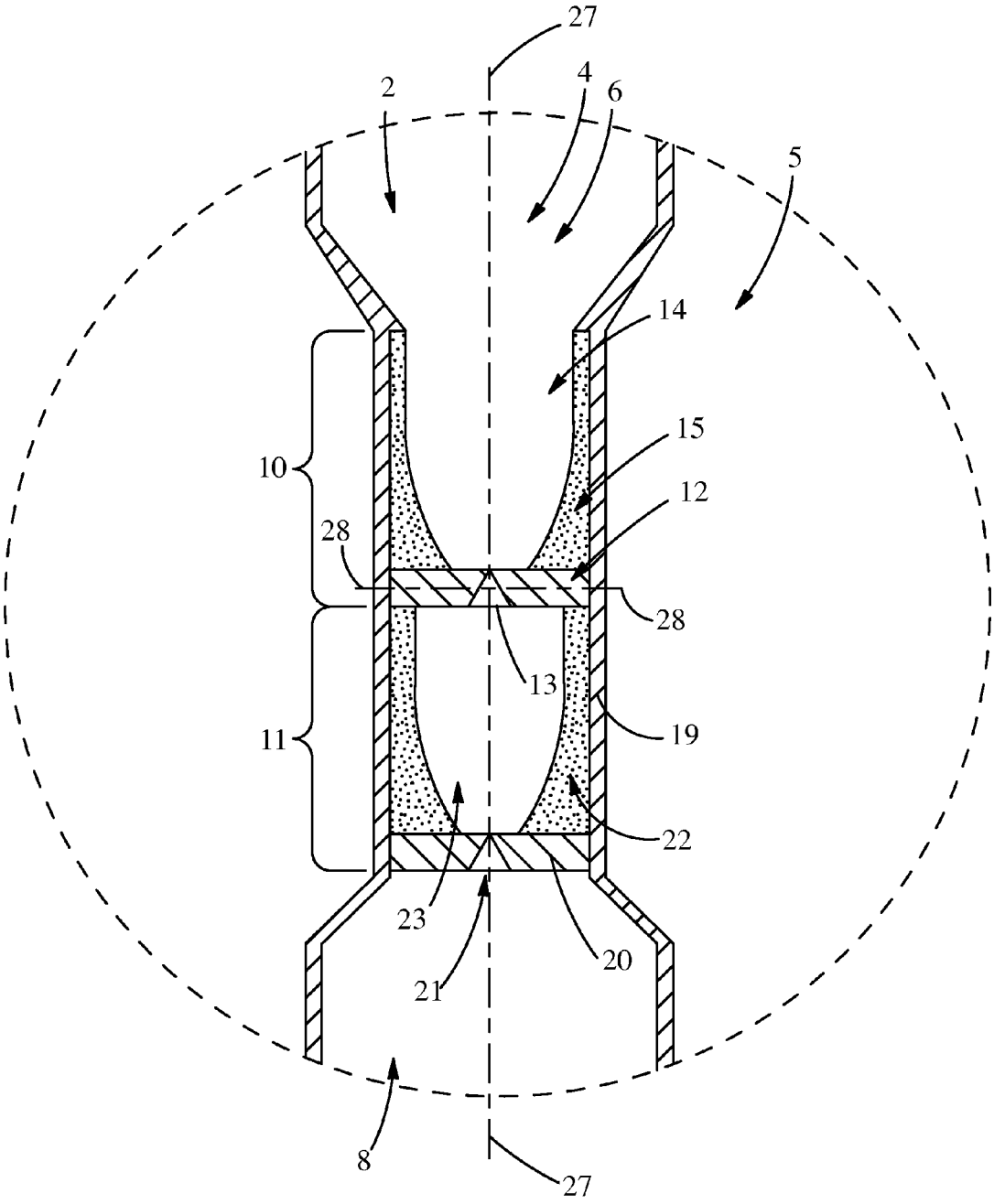
FIG. 2 details the orifice component 5 of the apparatus used in the method of the present invention.

As can be seen in FIG. 2, the orifice component comprises at least two orifice units 10 and 11 arranged in series to one another. Each orifice unit comprises an orifice plate 12 comprising at least one orifice 13, an orifice chamber 14 located upstream from the orifice plate and in liquid communication with the orifice plate. In one embodiment, the orifice unit 10 further comprises an orifice bracket 15 located adjacent to and upstream from the orifice plate 12, the walls of the orifice bracket 15 defining a passageway through the orifice chamber 14.

In another embodiment, the apparatus 100 comprises at least 5 orifice units arranged in series. In yet another embodiment, the apparatus 100 comprises at least 10 orifice units arranged in series.

The apparatus 100 may, but need not, further comprise at least one blade 16, such as a knife-like blade, disposed in the secondary mixing chamber 8 opposite the orifice component 5.

The components of the present apparatus 100 can include an injector component, an inlet housing 24, a pre-mixing chamber housing 25, an orifice component housing 19, the orifice component 5, a secondary mixing chamber housing 26, a blade holder 17, and an adjustment component 31 for adjusting the distance between the tip of blade 16 and the discharge of the orifice component 5. It may also be desirable for there to be a throttling valve (which may be external to the apparatus 100) that is located downstream of the secondary mixing chamber 8 to vary the pressure in the secondary mixing chamber 8. The inlet housing 24, pre-mixing chamber housing 25, and secondary mixing chamber housing 26 can be in any suitable configurations. Suitable configurations include, but are not limited to cylindrical, configurations that have elliptical, or other suitable shaped cross-sections. The configurations of each of these components need not be the same. In one embodiment, these components generally comprise cylindrical elements that have substantially cylindrical inner surfaces and generally cylindrical outer surfaces.

These components can be made of any suitable material(s), including but not limited to stainless steel, AL6XN, Hastalloy, and titanium. It may be desirable that at least portions of the blade 16 and orifice component 5 to be made of materials with higher surface hardness or higher hardnesses. The components of the apparatus 100 can be made in any suitable manner, including but not limited to, by machining the same out of solid blocks of the materials described above. The components may be joined or held together in any suitable manner.

The various elements of the apparatus 100 as described herein, are joined together. The term "joined", as used in this specification, encompasses configurations in which an element is directly secured to another element by affixing the element directly to the other element; configurations in which the element is indirectly secured to the other element by affixing the element to intermediate member(s) which in turn are affixed to the other element; configurations where one element is held by another element; and configurations in which one element is integral with another element, i.e., one element is essentially part of the other element. In certain embodiments, it may be desirable for at least some of the components described herein to be provided with threaded, clamped, or pressed connections for joining the same together. One or more of the components described herein can, for example, be clamped, held together by pins, or configured to fit within another component.

The apparatus 100 comprises at least one inlet 1A, and typically comprises two or more inlets, such as inlets 1A and 1B, so that more than one material can be fed into the apparatus 100. The apparatus 100 can comprise any suitable number of inlets so that any of such numbers of different materials can be fed into the apparatus 100. In another embodiment, a pre-mix of two liquids can be introduced into just one inlet of the apparatus 100. This pre-mix is then subjected to shear, turbulence and/or cavitation as it is fed through the apparatus 100.

The apparatus 100 may also comprise at least one drain, or at least one dual purpose, bidirectional flow conduit that serves as both an inlet and drain. The inlets and any drains may be disposed in any suitable orientation relative to the remainder of the apparatus 100. The inlets and any drains may, for example, be axially, radially, or tangentially oriented relative to the remainder of the apparatus 100. They may form any suitable angle relative the longitudinal axis of the apparatus 100. The inlets and any drains may be disposed on the sides of the apparatus. If the inlets and drains are disposed on the sides of the apparatus, they can be in any suitable orientation relative to the remainder of the apparatus.

In one embodiment the apparatus 100 comprises one inlet 1A in the form of an injector component that is axially oriented relative to the remainder of the apparatus. The injector component comprises an inlet for a first material.

The pre-mixing chamber 2 has an upstream end 3, a downstream end 4, and interior walls. In certain embodiments, it may further be desirable for at least a portion of the pre-mixing chamber 2 to be provided with an initial axially symmetrical constriction zone 18 that is tapered (prior to the location of the downstream end of the injector) so that the size (e.g. diameter) of the upstream mixing chamber 2 becomes smaller toward the downstream end 4 of the pre-mixing chamber 2 as the orifice component 5 is approached.

The orifice component 5 can be in any suitable configuration. In some embodiments, the orifice component 5 can comprise a single component. In other embodiments, the orifice component 5 can comprise one or more components of an orifice component system. One non-limiting embodiment of an orifice component system 5 is shown in greater detail in FIG. 2.

The apparatus comprises an orifice component 5, wherein the orifice component comprises at least a first orifice unit 10 and a second orifice unit 11.

In the embodiment shown in FIG. 2 the orifice component 5 comprises an orifice component housing 19. The first orifice unit 10 comprises a first orifice plate 12 comprising a first orifice 13 and a first orifice chamber 14. In one embodiment, the first orifice unit 10 further comprises a first orifice bracket 15. The second orifice unit 11 also comprises a second orifice plate 20 comprising a second orifice 21, a second orifice chamber 23 and optionally a second orifice bracket 22. Looking at these components in greater detail, the orifice component housing 19 is a generally cylindrically-shaped component having side walls and an open upstream end 6, and a substantially closed (with the exception of the opening for the second orifice 21) downstream end 7.

Looking now at the first orifice unit 10, the orifice chamber 14 is located upstream from, and in liquid communication with, the orifice plate 12. The first orifice bracket 15 is sized and configured to fit inside the orifice component housing 9 adjacent to, and upstream of, the first orifice plate 12 to hold the first orifice plate 12 in place within the orifice component housing 9. The first orifice bracket 15 has interior walls which define a passageway through the first orifice chamber 14.

The second orifice unit 11 is substantially the same construction as the first orifice unit 10.

The orifice units 10 and 11 are arranged in series within the orifice component 5. Any number of orifice units can be arranged in series within the orifice component 5. Each orifice plate can comprise at least one orifice. The orifices can be arranged anywhere upon the orifice plate, providing they allow the flow of liquids through the apparatus 100. Each orifice plate can comprise at least one orifice arranged in a different orientation than the next orifice plate. In one embodiment, each orifice plate comprises at least one orifice that is arranged so that it is off-centered as compared to the orifice in the neighbouring orifice plate. In one embodiment, the size of the orifice within the orifice plate can be adjusted in situ to make it bigger or smaller, i.e. without changing or removing the orifice plate.

The first orifice bracket 15 and second orifice bracket 22, can be of any suitable shape or size, providing they secure the first orifice plates during operation of the apparatus 100. FIGS. 1 and 2 show a non-limiting example of the orientation and size of an orifice bracket 22. In another embodiment, the orifice bracket 22 may extend only half the distance between the second orifice plate 20 and the first orifice plate 12. In yet another embodiment, the second orifice bracket 22 may extend only a quarter of the distance between the second orifice plate 20 and the first orifice plate 12.

In one embodiment, the orifice plate 12 is hinged so that it can be turned 90° about its central axis. The central axis can be any central axis, providing it is perpendicular to the centre-line 27, which runs along the length of the apparatus 100. In one embodiment, the central-axis can be along the axis line 28. By allowing the orifice 12 to be moved 90° about its central axis, build up of excess material in the first orifice chamber 14 and/or second orifice chamber 23 can be more readily removed. In one embodiment, the size and/or orientation of the first orifice bracket 15 can be adjusted to allow the rotation of the first orifice plate 12. For example, in one embodiment, the first orifice bracket 15 can be unsecured and moved in an upstream direction away from the first orifice plate 12 towards the pre-mixing chamber 2. The orifice plate 12 can then be unsecured and rotated through 90°. Once the apparatus 100 is clean, the first orifice plate 12 can be returned to its original operating configuration and then if present, the first orifice bracket 15 returned to its original operating position. The second orifice plate 20 and also any extra orifice plates present, may also be hinged. The second orifice bracket 22 and any other orifice brackets present may also be adjustable in the manner as described for the first orifice bracket 15.

Any two orifice plates must be distinct from one another. In other words neighbouring orifice plates must not be touching. By "neighbouring", we herein mean the next orifice plate in series. If two neighbouring plates are touching, mixing of liquids between orifices is not achievable. In one embodiment, the distance between the first orifice plate 12 and the second orifice plate 20 is equal to or greater than 1 mm.

The elements of the orifice component 5 form a channel defined by walls having a substantially continuous inner surface. As a result, the orifice component 5 has few, if any, crevices between elements and may be easier to clean than prior devices. Any joints between adjacent elements can be highly machined by mechanical seam techniques, such as electro polishing or lapping such that liquids cannot enter the seams between such elements even under high pressures.

The orifice component 5, and the components thereof, can be made of any suitable material or materials. Suitable materials include, but are not limited to stainless steel, tool steel, titanium, cemented tungsten carbide, diamond (e.g., bulk diamond) (natural and synthetic), and coatings of any of the above materials, including but not limited to diamond-coated materials.

The orifice component 5, and the elements thereof, can be formed in any suitable manner. Any of the elements of the orifice component 5 can be formed from solid pieces of the materials described above which are available in bulk form. The elements may also be formed of a solid piece of one of the materials specified above, which may or may not be coated over at least a portion of its surface with one or more different materials specified above. Since the apparatus 100 requires lower operating pressures than other shear, turbulence and/or cavitation devices, it is less prone to erosion of its internal elements due to mechanical and/or chemical wear at high pressures. This means that it may not require expensive coating, such as diamond-coating, of its internal elements.

In other embodiments, the orifice component 5 with the first orifice 13 and the second orifice 21 therein can comprise a single component having any suitable configuration, such as the configuration of the orifice component shown in FIG. 2. Such a single component could be made of any suitable material including, but not limited to, stainless steel. In other embodiments, two or more of the elements of the orifice component 5 described above could be formed as a single component.

The first orifice 13 and second orifice 21 are configured, either alone, or in combination with some other component, to mix the fluids and/or produce shear, turbulence and/or cavitation in the fluid(s), or the mixture of the fluids. The first orifice 13 and second orifice 21 can each be of any suitable configuration. Suitable configurations include, but are not limited to slot-shaped, eye-shaped, cat eye-shaped, elliptically-shaped, triangular, square, rectangular, in the shape of any other polygon, or circular.

The blade 16 has a front portion comprising a leading edge 29, and a rear portion comprising a trailing edge 30. The blade 16 also has an upper surface, a lower surface, and a thickness, measured between the upper and lower surfaces. In addition, the blade 16 has a pair of side edges and a width, measured between the side edges.

As shown in FIG. 1, when the blade 16 is inserted into the apparatus 100, a portion of the rear portion of the blade 16 is clamped, or otherwise joined inside the apparatus so that its position is fixed. The blade 16 can be configured in any suitable manner so that it can be joined to the inside of the apparatus.

As shown in FIG. 1, in some embodiments, the apparatus 16 may comprise a blade holder 17.

The apparatus 100 comprises at least one outlet or discharge port 9.

The apparatus 100 may comprise one or more extra inlets. These extra inlets can be positioned anywhere on the apparatus 100 and may allow for the addition of extra liquids. In one embodiment, the second orifice unit comprises an extra inlet. In another embodiment, the secondary mixing chamber comprises an extra inlet. This allows for the addition of an extra liquid to be added to liquids that have exited the orifice component 5.

It is also desirable that the interior of the apparatus 100 be substantially free of any crevices, nooks, and crannies so that the apparatus 100 will be more easily cleanable between uses. In one embodiment of the apparatus 100 described herein, the orifice component 5 comprises several elements that are formed into an integral structure. This integral orifice component 5 structure fits as a unit into the pre-mixing chamber housing and requires no backing block to retain the same in place, eliminating such crevices.

Numerous other embodiments of the apparatus 100 and components therefor are possible as well. The blade holder 17 could be configured to hold more than one blade 16. For example, the blade holder 17 could be configured to hold two or more blades.

The Liquid Fabric Softening Active Composition

A liquid fabric softening active composition is introduced into the apparatus 100 through the first inlet 1A. The liquid fabric softening active composition comprises a fabric softening active and a solvent.

In a preferred embodiment, the fabric softening active is present at a concentration between 85% and 95% by weight of the fabric softening active composition.

In another embodiment, the fabric softener active is a quaternary ammonium compound, preferably a diester quaternary ammonium compound.

The fabric softening active composition also comprises a solvent, preferably selected from the group comprising ethanol and/or isopropanol.

In one embodiment, the liquid fabric softening active composition is added in a molten form. The liquid fabric softening active composition is preferably heated to a temperature between 70° C. and 90° C. in order to make it molten.

Suitable fabric softening actives for use in the present invention are detailed below.

In one embodiment, the fabric softening active comprises, as the principal active, compounds of the formula $$\{R_{4-m}—N^{+}—[(CH_2)_n—Y—R^1]_m\}X^{-} \quad (1)$$

wherein each R substituent is either hydrogen, a short chain $C_1$-$C_6$, preferably $C_1$-$C_3$ alkyl or hydroxyalkyl group, e.g., methyl, ethyl, propyl, hydroxyethyl, and the like, poly ($C_{2-3}$ alkoxy), preferably polyethoxy, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, preferably $C_{14}$-$C_{20}$, with each $R^1$ being a hydrocarbyl, or substituted hydrocarbyl group, and $X^-$ can be any softener-compatible anion, preferably, chloride, bromide, methylsulfate, ethylsulfate, sulfate, and nitrate, more preferably chloride or methyl sulfate;

In another embodiment, the fabric softening active has the general formula:

$$[R_3N^{+}CH_2CH(YR^1)(CH_2YR^1)]X^{-}$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R is a methyl or ethyl group and preferably each $R^1$ is in the range of $C_{15}$ to $C_{19}$. As used herein, when the diester is specified, it can include the monoester that is present.

These types of agents and general methods of making them are disclosed in U.S. Pat. No. 4,137,180, Naik et al., issued Jan. 30, 1979, which is incorporated herein by reference. An example of a preferred DEQA (2) is the "propyl" ester quaternary ammonium fabric softener active having the formula 1,2-di(acyloxy)-3-trimethylammoniopropane chloride.

In another embodiment, the fabric softening active has the formula:

$$[R_{4-m}—N^{+}—R^1{}_m]X^{-} \quad (3)$$

wherein each R, $R^1$, and $X^-$ have the same meanings as before.

In yet another embodiment, the fabric softening active has the formula:

(4)

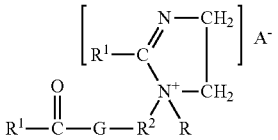

wherein each R, $R^1$, and $A^-$ have the definitions given above; each $R^2$ is a $C_{1-6}$ alkylene group, preferably an ethylene group; and G is an oxygen atom or an —NR— group;

In another embodiment, the fabric softening active has the formula:

(5)

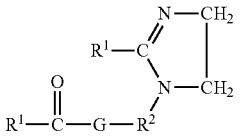

wherein $R^1$, $R^2$ and G are defined as above.

In another embodiment, the fabric softening actives are condensation reaction products of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and each $R^3$ is a $C_{1-6}$ alkylene group, preferably an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al., which is incorporated herein by reference;

In another embodiment, the fabric softening active has the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above;

In yet another embodiment, the fabric softening active are reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

In another embodiment, the fabric softening active has the formula:

(9)

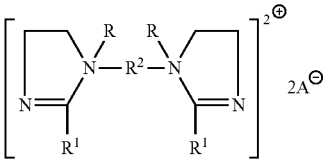

wherein R, $R^1$, $R^2$, and $A^-$ are defined as above.

Non-limiting examples of compound (1) are N,N-bis(stearoyl-oxy-ethyl) N,N-dimethyl ammonium chloride, N,N-bis(tallowoyl-oxy-ethyl)N,N-dimethyl ammonium chloride, N,N-bis(stearoyl-oxy-ethyl)N-(2 hydroxyethyl)N-methyl ammonium methylsulfate.

Non-limiting examples of compound (2) is 1,2 di(stearoyl-oxy) 3 trimethyl ammonium propane chloride.

Non-limiting examples of Compound (3) are dialkylenedimethylammonium salts such as dicanoladimethylammonium chloride, di(hard)tallowedimethylammonium chloride dicanoladimethylammonium methylsulfate. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of Compound (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of Compound (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of Compound (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group, available commercially from the Witco Corporation e.g. under the trade name Varisoft® 222LT.

An example of Compound (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of Compound (9) is the diquaternary compound having the formula:

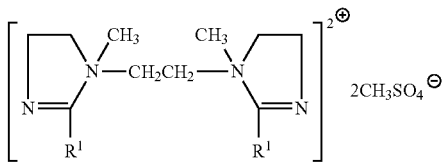

wherein $R^1$ is derived from fatty acid, and the compound is available from Witco Company.

It will be understood that combinations of softener actives disclosed above are suitable for use in this invention.

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

In some embodiments, it may be desirable for the liquid fabric softening active composition to comprise two or more different phases, or multiple phases. The different phases can comprise one or more liquid, gas, or solid phases. In the case of liquids, it is often desirable for the liquid to contain sufficient dissolved gas for cavitation. Suitable liquids include, but are not limited to water, oil, solvents, liquefied gases, slurries, and melted materials that are ordinarily solids at room temperature. Melted solid materials include, but are not limited to waxes, organic materials, inorganic materials, polymers, fatty alcohols, and fatty acids.

The liquid fabric softening active can also have solid particles therein. The particles can comprise any suitable material. The particles can be of any suitable size, including macroscopic particles and nanoparticles. These particles may be present in any suitable amount in the liquid fabric softening active.

Second Liquid Composition

The apparatus 100 also comprises a second inlet 1B. The second inlet 1B is used to introduce a second liquid composition. The second liquid composition may comprise any of the general types of materials described in conjunction with the liquid fabric softening active that appear in liquid fabric softening compositions known in the art. These are exemplified below. The second liquid composition may also be heated or unheated. In one embodiment, the temperature of the second liquid composition is between 40° C. and 70° C.

The second liquid composition may comprise components selected from the group comprising, silicone compounds, perfumes, encapsulated perfumes, dispersing agents, stabilizers, pH control agents, colorants, brighteners, dyes, odor control agent, pro-perfumes, cyclodextrin, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, thickeners, chelants, electrolytes and mixtures thereof.

In one embodiment, the second liquid composition comprises silicone compounds, preferably polydimethyl siloxane compounds.

The pH of the second liquid composition should be adjusted such that the pH of the final resultant liquid fabric softening composition preferably has a pH between 2.5 and 3.2. This pH range is preferable as it increases the stability of the fabric softening active.

Process of Producing a Liquid Fabric Softener Composition

The present invention is to a process of producing a liquid fabric softening composition comprising a fabric softening active, said process comprising the steps of;

Taking an apparatus 100 comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear, turbulence and/or cavitation in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear, turbulence and/or cavitation in the liquid, the at least one outlet 9 being located at the downstream end of the secondary mixing chamber 8; the orifice component 5 comprising at least two orifice units, 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighbouring orifice plates are distinct from each other;

connecting one or more suitable liquid pumping devices to the first inlet 1A and to the second inlet 1B;

pumping a liquid fabric softening active composition into the first inlet 1A, and, pumping a second liquid composition into the second inlet 1B, wherein the operating pressure of the apparatus is between 0.1 bar and 50 bar, the operating pressure being the pressure of the liquid as measured in the pre-mix chamber 2;

allowing the liquid fabric softening active and the second liquid composition to pass through the apparatus 100 at a desired flow rate, wherein as they pass through the apparatus 100, they are dispersed one into the other;

discharging the resultant liquid fabric softening composition produced out of the outlet 9.

The process comprises introducing, in the form of separate streams, the fabric softening active in a liquid form and a second liquid composition comprising other components of a fabric softening composition into the pre-mixing chamber 2 so that the liquids pass through the orifice component 5. The fabric softener active in a liquid form and the second liquid composition pass through the orifice component 5 under pressure. The fabric softener active in liquid form and the second liquid composition can be at the same or different operating pressures. The orifice component 5 is configured, either alone, or in combination with some other component, to mix the liquid fabric softener active and the second liquid composition and/or produce shear, turbulence and/or cavitation in each liquid, or the mixture of the liquids.

The liquids can be supplied to the apparatus 100 in any suitable manner including, but not limited to through the use of pumps and motors powering the same. The pumps can supply the liquids to the apparatus 100 under the desired operating pressure. In one embodiment, an '8 frame block-style manifold' is used with a 781 type Plunger pump available from CAT pumps (1681 94th Lane N E, Minneapolis, Minn. 55449).

The operating pressure of conventional shear, turbulence and/or cavitation apparatuses is between about 6.9 bar and 690 bar. The operating pressure is the pressure of the liquid in the pre-mix chamber 2. The operating pressure is provided by the pumps.

The operating pressure of the present invention is measured using a Cerphant T PTP35 pressure switch with a RVS membrane, manufactured by Endress Hauser (Endress+Hauser Instruments, International AG, Kaegenstrasse 2, CH-4153, Reinach). The switch is connected to the pre-mix chamber 2 using a conventional thread connection (male thread in the pre-mix chamber housing, female thread on the Cerphant T PTP35 pressure switch).

The preferred operating pressure of the present invention is lower than conventional shear, turbulence and/or cavitation processes, yet the same degree of liquid mixing is achievable as seen with processes using conventional apparatuses. Also, at the same operating pressures, the process of the present invention results in better mixing than is seen with conventional shear, turbulence and/or cavitation processes. In one embodiment, the apparatus 100 has an operating pressure between 0.1 bar and 50 bar. In another embodiment the operating pressure of the apparatus 100 is between 0.25 bar and 20 bar. In yet another embodiment, the operating pressure of the apparatus 100 is between 0.5 bar and 10 bar. It should be noted that the apparatus 100 can also, if desired, be operated at the higher pressures (up to 690 bar) seen in conventional processes.

As the fabric softening active and the second liquid composition flow through the apparatus 100, they pass through the orifices 13 and 21 of the orifice component 5. As they do, they exit the orifice 13 and/or 21 in the form of a jet. This jet produces shear, turbulence and/or cavitation in the fabric softening active and the second liquid composition, thus dispersing them one in the other to form a uniform and stable dispersion.

In conventional shear, turbulence and/or cavitation processes, the fact that the liquids are forced through the orifice 13 and/or 21 under high pressure causes them to mix. This same degree of mixing is achievable at lower pressures when the liquids are forced through a series of orifices, rather than one at a high pressure. Also, at equivalent pressures, the process of the present invention results in better liquid mixing than shear, turbulence and/or cavitation processes, due to the fact that the liquids are now forced through a series of orifices.

A given volume of liquid can have any suitable residence time and/or residence time distribution within the apparatus 100. Some suitable residence times include, but are not limited to from about 1 microsecond to about 1 second, or more. The liquid(s) can flow at any suitable flow rate through the apparatus 100. Suitable flow rates range from about 1 to about 1,500 L/minute, or more, or any narrower range of flow rates falling within such range including, but not limited to from about 5 to about 1,000 L/min.

The process may be used to make many different kinds of fabric softening composition products including, but not limited to liquids, emulsions, dispersions, gels and blends.

In one embodiment, the resultant fabric softening composition is liquid at room temperature. In another embodiment, the resultant fabric softening composition is highly concentrated. By highly concentrated we herein mean the fabric softening active is present between 50% and 90% by weight of the fabric softening composition. In yet another embodiment, the resultant fabric softening composition is highly concentrated and is liquid at ambient temperature. The term liquid can encompass non-viscous liquids, viscous liquids, emulsions, dispersions, a gels or blends. The resultant fabric softening composition can encompass structured liquids, where the structuring is provided by the particles residing in the dispersion. These particles can be of any shape and size.

Those skilled the art will recognize what concentrations of components to add to achieve the resultant desired composition.

Another aspect of the present invention, is a liquid fabric softening composition made using the process of the present invention. The liquid fabric softening composition can be used in a conventional automatic laundry machine, or can be used as a hand washing fabric softening composition.

EXAMPLES

The following examples demonstrate how the process of the present invention can be used to make a fabric softening composition that comprises the same degree of dispersion of the liquid components as alternative high pressure apparatuses known in the art, but utilizes lower operating pressures than these alternative apparatuses. In the context of high shear, turbulence and/or cavitation mixing devices, the extent of a dispersion or emulsification can be assessed by a comparison of mean particle size, or mean particle size distribution. High shear, turbulence and/or cavitation mixing devices produce dispersion and/or emulsion compositions that comprise particles, these particles having a range of sizes. It is desirable to achieve a particular mean particle size, which requires a particular operating pressure. It is also desirable to achieve a particular particle size distribution. Generally, if a higher percentage of smaller particles are required, a higher operating pressure is necessary.

Example 1

Two liquids were fed into the apparatus 100, each through a separate inlet. The first liquid was a molten (80° C.) cationic surfactant (91% molten diethyl ester dimethyl ammonium chloride, 9% isopropanol) composition. The second liquid was water at 60° C. The final composition produced was 6% cationic surfactant, 94% water.

The same composition was fed into a Sonolator® High Pressure Homogenizer, again as two separate feeds. The orifice in the Sonolator was 1.1 $mm^2$.

Both devices were used with an operating pressure of 4 bar+/−0.2 bar, as measured using a Cerphant T PTP35 pressure switch with a RVS membrane, manufactured by Endress Hauser (Endress+Hauser Instruments, International AG, Kaegenstrasse 2, CH-4153, Reinach). The switch is connected to the pre-mix chamber using a conventional thread connection (male thread in the pre-mix chamber housing, female thread on the Cerphant T PTP35 pressure switch). The flow rate was maintained at 5 kg/min+/−0.25 kg/min, as measured by an Endress & Hauser Promass M flowmeter using standard techniques known in the art.

The apparatus of the present invention was prepared with 4 orifice plates, each spaced 12 mm from the neighbouring plate. Each plate comprised one circular orifice having a diameter of 1.9 mm. The orifices were aligned with each other along the centre-line 27 of the apparatus 100.

TABLE 1

| | Sonolator | Apparatus (100) |
|---|---|---|
| Viscosity at 1 $s^{-1}$ (mPa s) | 20 | 14 |
| Mean Particle size (nm) | 219 | 177 |

As can be seen from Table 1, at 4 bar pressure, the apparatus 100 produced a smaller mean particle size as measured using a Malvern Zeta Sizer Nano-ZS Particle Size Distribution Analyzer (sample was diluted 100 times before measurement) using a standard Malvern Zeta Sizer measuring cell. Smaller resultant particle size is indicative of better liquid-liquid dispersion, as this shows that the liquids were more efficiently mixed. The apparatus of the present invention also produced a composition having a lower viscosity as measured using a Anton Paar Rheometer at 21° C., using a "bob and cup" concentric cylinder measuring system; specifically, an Anton Paar CC27 (27 mm diameter) bob and an Anton Paar CC27 stainless steel cup, using standard techniques known in the art.

A person skilled in the art will recognize that, in the case of a vesicular dispersion as the one achieved in Example 1, the smaller the particle size, the lower the viscosity of the dispersion.

Example 2

Two liquids were fed into the apparatus 100, each through a separate inlet. The first liquid was a molten (80° C.) cationic surfactant (91% molten diethyl ester dimethyl ammonium chloride, 9% isopropanol) composition. The second liquid was water at 60° C. The final composition produced was 10% cationic surfactant, 90% water.

The same composition was fed into a Sonolator® High Pressure Homogenizer, again as two separate feeds. The orifice in the Sonolator was 0.65 $mm^2$.

The operating pressure required to produce a composition comprising a particle size population having 95% of particles below 0.2 μm in size was measured using a Cerphant T PTP35 pressure switch with a RVS membrane, manufactured by Endress Hauser (Endress+Hauser Instruments, International AG, Kaegenstrasse 2, CH-4153, Reinach). The switch is connected to the pre-mix chamber using a conventional thread connection (male thread in the pre-mix chamber housing, female thread on the Cerphant T PTP35 pressure switch).

This was repeated for compositions having a particle size population having 95% of particles below 0.5 μm, and lastly below 1.0 μm.

The apparatus of the present invention was prepared with 5 orifice plates, each spaced 15 mm from the neighbouring plate. Each plate comprised one circular orifice having a diameter of 1.9 mm. The orifices were aligned with each other along the centre-line 27 of the apparatus 100.

TABLE 2

| | Pressure needed to achieve 95% of the population below 0.2 μm. | Pressure needed to achieve 95% of the population below 0.5 μm. | Pressure needed to achieve 95% of the population below 1.0 μm. |
|---|---|---|---|
| Sonolator | 50 bar | 20 bar | 8 bar |
| Apparatus of present invention | 15 bar | 5 bar | 2 bar |

Samples were diluted 100 times and particle size distribution measured using a Horiba LA-920. Laser Scattering Particle Size Distribution Analyzer using standard techniques known in the art.

As can be seen from Table 2, the apparatus 100 uses a lower pressure to achieve a given desired particle size distribution than the Sonolator® High Pressure Homogenizer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of producing a liquid fabric softening composition comprising a fabric softening active, said process comprising the steps of;

Taking an apparatus comprising:

at least a first inlet, a second inlet and a pre-mixing chamber, the pre-mixing chamber having an upstream end and a downstream end, the upstream end of the pre-mixing chamber being in liquid communication with the first inlet and the second inlet; an orifice component, the orifice component having an upstream end and a downstream end, the upstream end of the orifice component being in liquid communication with the downstream end of the pre-mixing chamber, wherein the orifice component is configured to spray liquid in a jet and produce shear, turbulence and/or cavitation in the liquid; a secondary mixing chamber, the secondary mixing chamber being in liquid communication with the downstream end of the orifice component; at least one outlet in liquid communication with the secondary mixing chamber for discharge of liquid following the production of shear, turbulence and/or cavitation in the liquid, the at least one outlet being located at the downstream end of the secondary mixing chamber; the orifice component comprising at least two orifice units, and arranged in series to one another and each orifice unit comprising an orifice plate comprising at least one orifice, an orifice chamber located upstream from the orifice plate and in liquid communication with the orifice plate; and wherein neighbouring orifice plates are distinct from each other;

connecting one or more suitable liquid pumping devices to the first inlet and to the second inlet;

pumping a liquid fabric softening active composition into the first inlet, and, pumping a second liquid composition into the second inlet, wherein the operating pressure of the apparatus is between about 0.1 bar and about 50 bar, the operating pressure being the pressure of the liquid as measured in the pre-mix chamber;

allowing the liquid fabric softening active and the second liquid composition to pass through the apparatus at a desired flow rate, wherein as they pass through the apparatus, they are dispersed one into the other;

discharging the resultant liquid fabric softening composition produced out of the outlet.

2. The process of claim 1, wherein the fabric softening active composition comprises a fabric softening active and a solvent.

3. The process of claim 2, wherein the fabric softening active is a quaternary ammonium compound.

4. The process of claim 2, wherein the solvent is selected from the group comprising ethanol or isopropanol or combinations thereof.

5. The process of claim 1, wherein the fabric softening active is present between about 85% and about 95% by weight of the fabric softening active composition.

6. The process of claim 1, wherein the operating pressure of the apparatus is between about 0.25 bar and about 20 bar.

7. A liquid fabric softening composition made according to the process of claim 1.

* * * * *